US005931386A

United States Patent [19]

Jouillat

[11] Patent Number: 5,931,386

[45] Date of Patent: Aug. 3, 1999

[54] SPRAY NOZZLE HAVING AN OBLONG ATOMIZER

[75] Inventor: Claude Jouillat, Montigny-Sur-Avre, France

[73] Assignee: Valois S.A., Le Neubourg, France

[21] Appl. No.: 08/860,202

[22] PCT Filed: Jan. 9, 1996

[86] PCT No.: PCT/FR96/00028

§ 371 Date: Sep. 18, 1997

§ 102(e) Date: Sep. 18, 1997

[87] PCT Pub. No.: WO96/21512

PCT Pub. Date: Jul. 18, 1996

[30] Foreign Application Priority Data

Jan. 11, 1995 [FR] France ..... 95 00258

[51] Int. Cl.[6] ..... B05B 1/34

[52] U.S. Cl. ..... 239/463; 239/491; 239/518

[58] Field of Search ..... 239/333, 337, 239/461, 463, 491, 492, 493, 504, 505, 518

[56] References Cited

U.S. PATENT DOCUMENTS

| | | | |
|---|---|---|---|
| 3,840,157 | 10/1974 | Hellenkamp | 222/309 |
| 3,990,639 | 11/1976 | Laauwe | 239/492 |
| 4,036,439 | 7/1977 | Green | 239/493 |
| 4,182,496 | 1/1980 | Burke | 239/492 |
| 4,260,110 | 4/1981 | Werding | 239/492 |
| 4,678,123 | 7/1987 | Klaeger | 239/492 |
| 5,540,389 | 7/1996 | Knickerbocker | 239/491 |
| 5,711,488 | 1/1998 | Lund | 239/492 |
| 5,738,282 | 4/1998 | Grogan | 239/492 |

FOREIGN PATENT DOCUMENTS

| | | |
|---|---|---|
| 2325434 | 4/1977 | France . |
| 2443879 | 7/1980 | France . |
| 3314020 | 10/1984 | Germany . |

*Primary Examiner*—Andres Kashnikow
*Assistant Examiner*—Lisa Ann Douglas
*Attorney, Agent, or Firm*—Sughrue, Mion, Zinn, Macpeak & Seas, PLLC

[57] ABSTRACT

A spray nozzle mountable on the outlet (3) of a fluid dispensing device for dividing a fluid into fine droplets. The nozzle includes a core (11) and an atomizer (2) together defining a vortex chamber (14, 24) communicating with the outside via a spray port (21) in the atomizer (2), and a number of vortex channels (15, 16) opening non-radially into the vortex chamber (14, 24). The atomizer (2) has an oblong shape with a longitudinal major axis lying in a horizontal plane. The vortex channels (15, 16) preferably communicate with the outlet (3) of the spray device via two symmetrical feed ducts (12, 13) extending on either side of the core (11) and lying in a horizontal plane.

12 Claims, 4 Drawing Sheets

FIG.7
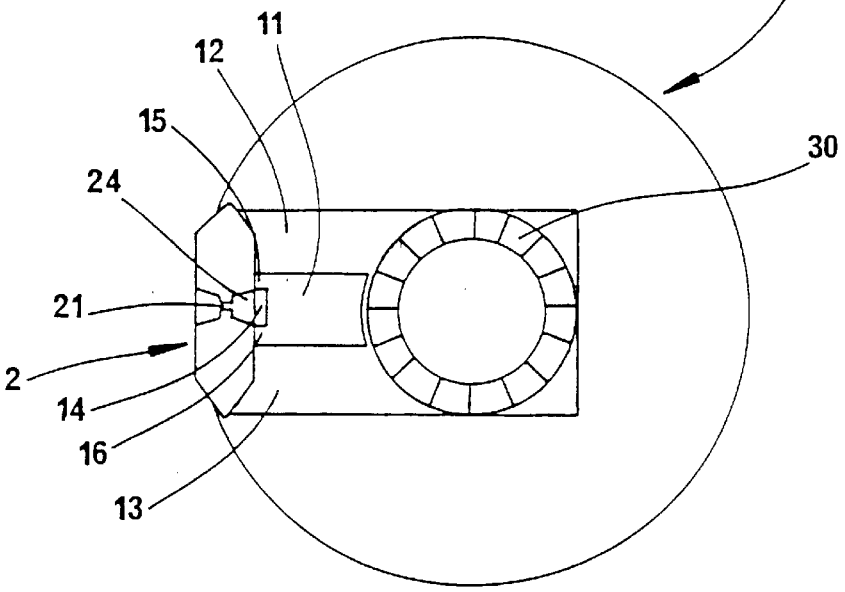
FIG.8
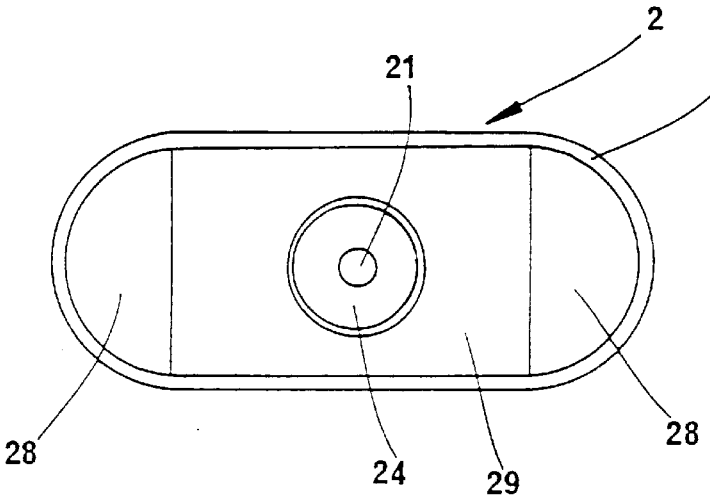
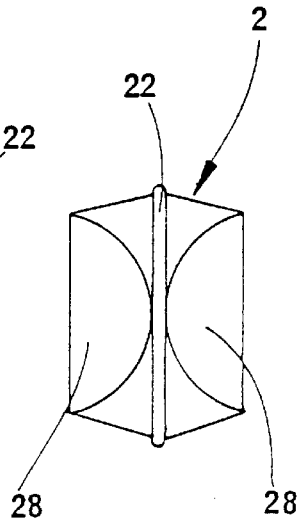
FIG.9
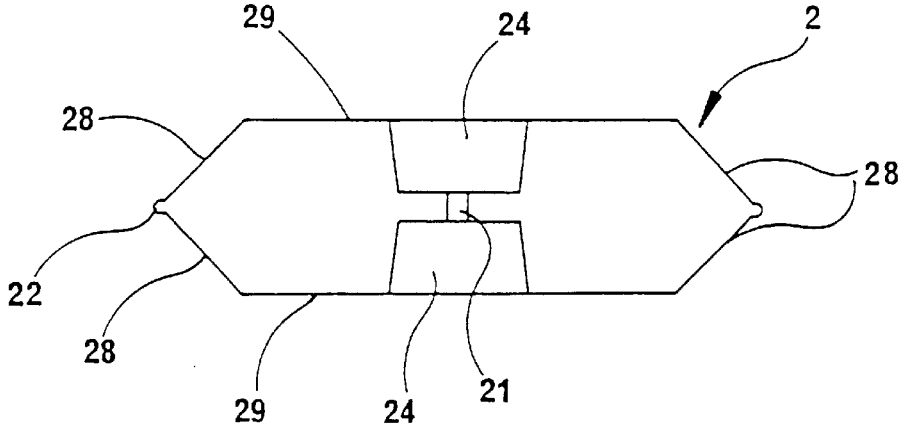
FIG.10

SPRAY NOZZLE HAVING AN OBLONG ATOMIZER

The present invention relates to a spray nozzle for mounting on an outlet channel of a fluid dispenser device for dividing the fluid into fine droplets. Certain fluids, such as perfumes for example, are preferably dispensed in spray form to increase dispersion of the fluid and to avoid application that is excessively localized. For this purpose, a spray nozzle is used mounted on the outlet channel of the dispenser which is generally a pump or a valve.

Spray nozzles are usually integrated in the pushbutton of the pump or valve, in which case they move vertically when the device is actuated. They may also be secured to a part of the device that remains stationary during actuation.

FIGS. 1 to 4 shows a conventional prior art spray nozzle integrated in a pushbutton 100. FIG. 1 is a front view of the nozzle with the atomizer omitted to show the inside of the nozzle. The pushbutton 100 is in the form of a small cylinder closed at a top end by an ergonomically curved surface 118 suitable for being pressed by a finger. The cylinder is made so that it has a cylindrical housing 110 which is partially occupied by a core 111 of cylindrical shape which extends horizontally along the center of the housing. An annular space 114 is thus created between the core 111 and the inside cylindrical wall of the housing 110. A window 112 puts the annular space 114 into communication with an internal channel 117, as can be seen in FIGS. 2 and 3. The internal channel 117 receives the end of a hollow actuator rod 103.

The core 111 has a smooth front surface 119. An atomizer 102 is engaged as a force fit on the core 111, as can be seen in FIG. 3. The atomizer 102 is in the form of a small beaker whose bottom is pierced by a "spray" orifice 121. The atomizer thus comprises an end wall and an annular skirt 122 which is engaged as a force fit in the annular space 114 (FIG. 1). Three angularly distributed feed channels 113 are formed in the inside wall of the skirt and extend along the full length of the skirt 122. The skirt does not come into contact with the end of the annular space 114, so there exists an annular passage 115 putting the window into communication with the feed channels 113 (FIG. 3). Also, the end wall of the nozzle 102 has a structured inside wall 129 in which there are formed three vortex channels 125 and a vortex chamber 124 centered on the spray orifice 121 (FIG. 4). The vortex channels and the vortex chamber are closed by pressing the inside surface 129 of the atomizer in sealed manner against the smooth front surface 119 of the core. The vortex channels are thus isolated from one another. Each of the three vortex channels 125 is in communication with a respective one of the three feed channels 113. The fluid dispensed by the pump or the valve thus flows along the hollow rod 103, the internal channel 117, the window 112, the annular passage 115, the three feed channels, the three vortex channels, the vortex chamber, and the spray orifice.

In that prior art nozzle, as in those disclosed in documents FR-2 325 434 and DE-3 314 020, the height of the nozzle is directly tied to the height of the atomizer, and consequently to the structure thereof.

An object of the present invention is to reduce the height of the nozzle, thereby enabling the total height of the dispenser device to be reduced.

To do this, the present invention provides a spray nozzle for mounting on an outlet channel of a device for dispensing a fluid to divide said fluid into fine droplets, said nozzle comprising a core and an atomizer together defining:

a vortex chamber which communicates with the outside via a spray orifice formed in said atomizer; and a plurality of vortex channels opening out into the vortex chamber in non-radial manner;

the atomizer being oblong in shape with its longitudinal major axis extending in a horizontal plane.

The effect of this embodiment is to reduce the height of the nozzle: whereas a conventional nozzle is inscribed in a circle, as can be seen with reference to FIG. 1, the nozzle of the invention is inscribed in the same circle, but only along its horizontal longitudinal major axis. Consequently, the nozzle is much less high than a conventional nozzle, thus making it possible to reduce the height of the part in which it is formed or integrated, such as a pushbutton.

Another problem with prior art spray nozzles lies in the fact that the feed channels and the vortex channels are fed from a single window 112. Unfortunately, the angular disposition of the feed and vortex channels is defined only when the atomizer is put into place, and since the atomizer is not angularly oriented, it is possible for one particular feed and vortex channel to be positioned, for example, exactly in register with the window, thus causing it to be favored over the other two. This gives rise to a poor distribution of the fluid going from the window into the various channels. This drawback is inevitable given that it is not possible to find a configuration that puts all three feed and vortex channels in an identical flow relationship relative to the window. The effect of this poor flow distribution is that the vortex in the vortex chamber is ill-formed, and as a consequence the spray is of poor quality. According to the invention, this problem is solved by advantageously providing for the vortex channels to communicate with the outlet channel of the spray device via a plurality of symmetrical feed ducts, with each of the vortex channels corresponding to a respective feed duct so that all of the vortex channels are fed with fluid in equal manner. This ensures that the flow path of the fluid is identical in each of the vortex channels.

There are preferably two feed ducts, extending on either side of the core in a horizontal plane.

It is thus possible to reduce height while simultaneously ensuring a well-balanced feed to the vortex channels. In this way, a nozzle of small size is made with the additional advantage of improved dynamic behavior. Further, since the atomizer is smaller in size, the fluid bears against an area of the atomizer that is likewise smaller in size. Specifically, the atomizer no longer needs to be engaged with as much force as in the prior art. For example, for a conventional nozzle, the atomizer must withstand a pressure of $30\times10^5$ Pa, whereas for a nozzle of the invention, a pressure of $12\times10^5$ Pa to $15\times10^5$ Pa suffices. It is thus easier to fasten an atomizer of the invention, since the fastening means do not need to withstand such high pressures.

Also, the fluid is sprayed by means of the vortex which is created in the vortex chamber because the vortex channels open out into the chamber in non-radial manner. The fluid is thus subject to vortex motion in the chamber, thereby generating centrifugal acceleration prior to leaving through the spray orifice which is accurately centered in the eye of the vortex. The ejected fluid is thus dispensed into the atmosphere and disperses conically.

It is essential for the spray orifice to be accurately centered on the eye of the vortex, since otherwise the fluid is dispensed in large droplets, since it is in the eye of the vortex that the acceleration is strongest. It is therefore necessary for the atomizer to be precision molded, to ensure that the vortex chamber is exactly centered on the spray orifice. In addition, the spray channels must also be precision molded, as must the feed channels. The atomizer thus constitutes a precision component. In addition, it is also necessary for the atomizer to be engaged on the core with great precision.

In order to simplify the design of the atomizer and relax its tolerances, said vortex channels and at least a portion of the vortex chamber are formed in a front wall of the core, the atomizer having an inside wall in sealing contact with said front wall of the core to isolate the vortex channels from one another.

According to another characteristic of the invention, the atomizer forms a portion of the vortex chamber. The vortex chamber is thus made up of two portions, one formed in the front wall of the core and the other in the atomizer. The portion formed in the atomizer corresponds to that in which the eye of the vortex forms. It has been observed that even if the two portions of the chamber are not exactly in alignment with each other, the eye of the vortex nevertheless forms in centered manner on the spray orifice, providing the spray orifice is itself accurately centered relative to the chamber portion formed in the atomizer. If the two portions are not accurately aligned, the vortex is merely slightly deformed, but its acceleration properties remain intact. It is thus the chamber portion formed in the atomizer that determines the position at which the eye of the vortex is formed.

Advantageously, the atomizer is symmetrical about a plane extending perpendicularly to the axis passing through the spray orifice, such that the atomizer has two identical faces and is thus reversible. The atomizer is then merely in the form of an oblong pellet pierced by a central hole formed between two symmetrical cylindrical recesses which define two vortex chamber portions. The atomizer does not include an annular skirt as in the prior art. As a result the atomizer is considerably simplified which provides various advantages. Firstly, because of its symmetry, the atomizer is reversible, which simplifies positioning the atomizer while it is being mounted on the core. Also, the atomizer needs less material because of its small size and lack of annular skirt. Also, it is simpler to mold using a mold having two identical mold-portions. Finally, the symmetrical chamber portions with the centered spray orifice are easier to make since the pin required for molding purposes is shorter, thereby increasing precision. It is thus possible to mold the atomizer of the invention with great precision while using a pin that is easier to handle.

According to another characteristic, the atomizer is hermetically received in a housing containing the feed ducts and the core, said atomizer being provided on its periphery in contact with said housing with a sealing rim that bites into the material constituting said housing. The atomizer is thus engaged as a force fit in the housing and it is held therein by a kind of barb effect. By using appropriate materials, it is possible to obtain such engagement by interference. Advantageously, said atomizer has a peripheral penetration chamfer for facilitating mounting of the atomizer in said housing. During mounting, there is no need for the atomizer to be presented to the housing in accurately centered manner. If it is not properly centered, the penetration chamfers serve to recenter the atomizer automatically in its housing. Also, the outlet channel of the spray device has a crenelated free end which communicates with the feed ducts of the nozzle. There is thus no need to provide for any particular arrangement in the nozzle to allow the fluid to flow away from the outlet channel. This also makes it possible to further reduce the height of the nozzle.

The nozzle may be an integral portion of a pushbutton mounted on a hollow actuator rod defining the outlet channel.

The invention is described below in greater detail with reference to the accompanying drawings, showing an embodiment of the present invention by way of non-limiting example.

In the drawings:

FIG. 1 is a front view of a pushbutton including a prior-art spray nozzle, the atomizer of the nozzle being omitted to show the inside of the nozzle;

FIG. 2 is a vertical section view through the prior-art pushbutton and nozzle of FIG. 1;

FIG. 3 is an enlarged view of the spray nozzle of FIGS. 1 and 2 with the atomizer in place; and FIG. 4 is a plan view of the FIG. 3 atomizer;

FIGS. 5 to 10 show an embodiment of a spray nozzle of the invention, and in these figures:

FIG. 5 is a front view of a pushbutton including a spray nozzle made in accordance with the present invention, the atomizer of the nozzle being omitted to show the inside of the nozzle;

FIG. 6 is a vertical section view of the pushbutton and the nozzle of the invention as shown in FIG. 5;

FIG. 7 is a horizontal section view of the pushbutton and the nozzle of the invention as shown in FIG. 5, but with the atomizer in place; and FIGS. 8 to 10 are enlarged views of the atomizer of the invention, shown respectively in front view, side view, and section view.

Figure 5:
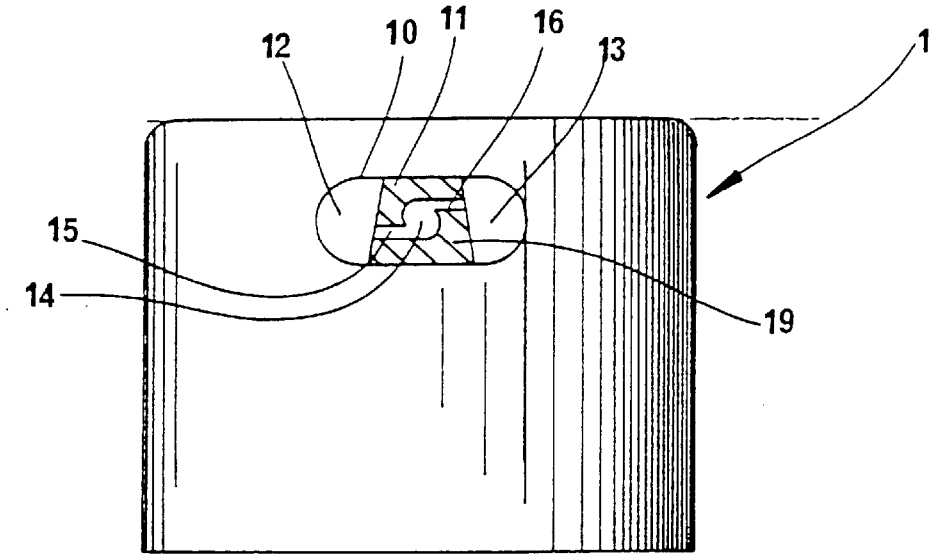
Figure 6:
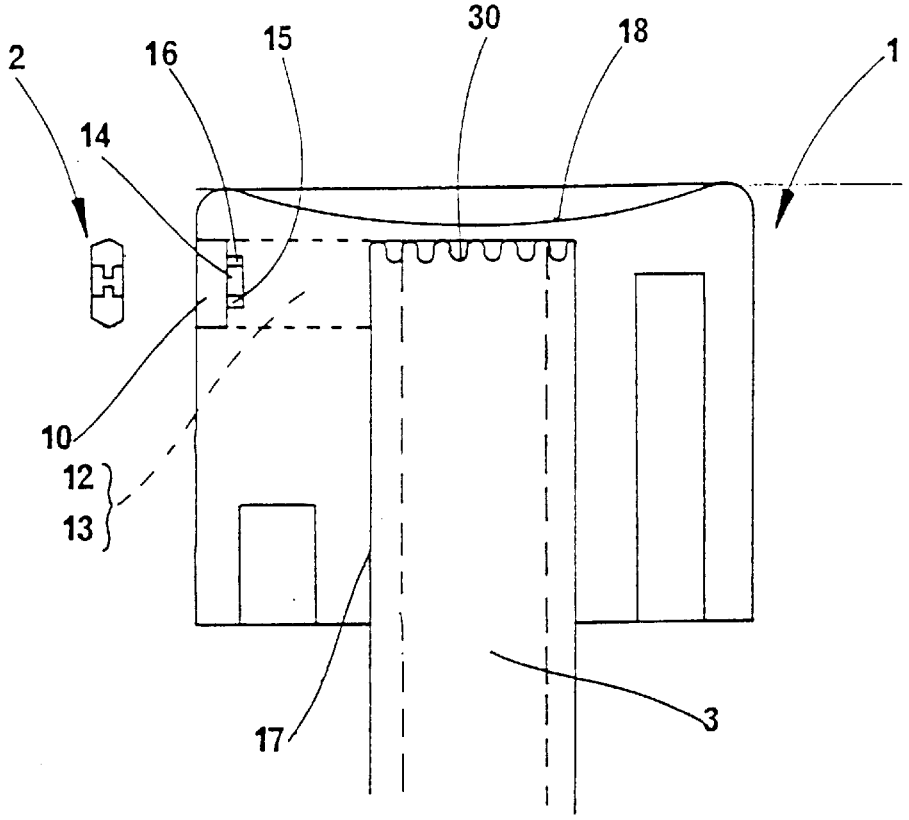

With reference to FIGS. 5 to 7, the pushbutton is given numerical reference 1 in this example. It is designed to be engaged on an outlet channel, such as a hollow actuator rod 3, of a fluid-dispensing device, such as a pump or a valve. The spray nozzle constituting an embodiment of the invention is integrated in the pushbutton 1, as is the usual practice. Nevertheless, the spray nozzle described in detail below could equally well be integrated in some other element of a spray device including an outlet channel. The invention relates to the specific structure of the nozzle and not to its disposition relative to the dispenser device. Nevertheless, the embodiment chosen to illustrate the invention implements the spray nozzle in a pushbutton of generally conventional shape.

Figure 1:
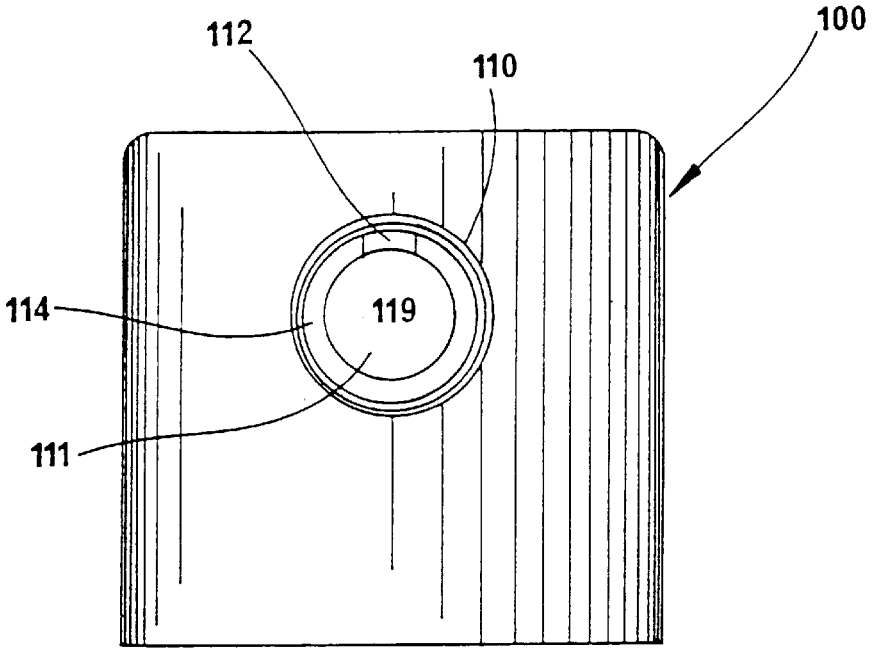
FIGS. 1 to 4 show the prior art and are described above, nevertheless.
Figure 2:
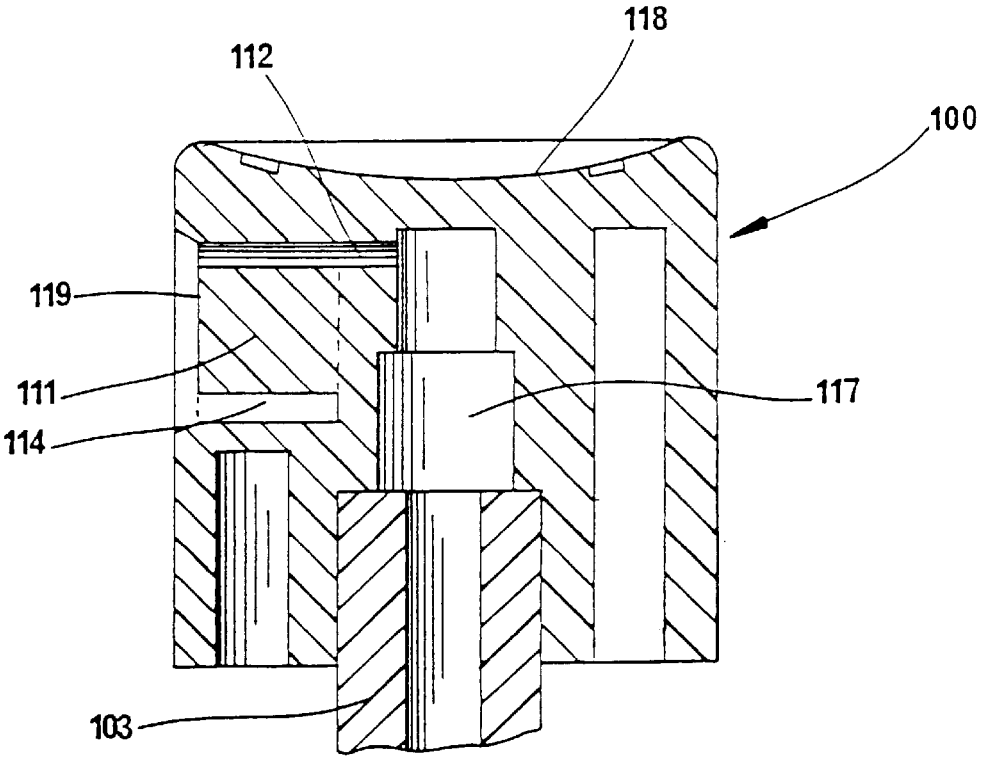

The pushbutton 1 is in the form of a small hollow cylinder closed at its top end by a surface 18 adapted to receive pressure exerted by a finger, for example. In its cylindrical portion, the pushbutton 1 includes an oblong housing 10 in which it receives an atomizer of corresponding shape. FIGS. 5 and 6 show the pushbutton with the atomizer removed to show the inside of the oblong housing 10. It contains a core 11 that occupies said housing 10 in part, together with two "feed" ducts 12 and 13 which penetrate into the pushbutton on either side of the core, extending parallel in a horizontal plane when the surface 18 faces upwards, as shown in FIGS. 5 and 6. Whereas it is conventional for the core to be surrounded by an annular passage (see 114 in FIG. 1), in the invention there are two distinct feed ducts 12 and 13 extending towards the center of the pushbutton 1 where they intercept an internal channel 17 formed in the pushbutton and in which the hollow actuator rod of the dispenser device is engaged as a force fit. The core no longer constitutes a projecting stud surrounded by an annular space, but is directly connected on top and underneath to the structural mass of the pushbutton 1, as can be seen in FIGS. 5 and 6. The core no longer projects freely forwards, but is literally an integral portion of the pushbutton. The core constitutes a kind of separating wall between the two feed ducts 12 and 13. The core 11 extends radially towards the inside of the pushbutton and terminates just before the opening into the internal channel 17 in which the actuator rod 3 is received.

The actuator rod has an open top end 30 which is crenelated, with the top of the crenelations in abutment against the top wall of the internal channel, which top wall also defines a portion of the thrust surface 18. Because of the crenelations, the fluid can escape from the actuator rod 3 without any need to provide special means at the top wall of the internal channel 17 to prevent the open top end 30 of the rod 3 coming into sealing contact with the top wall of the internal channel 17 which would prevent the fluid from flowing out. This helps reduce height since the actuator rod 3 penetrates to maximum extent into the pushbutton 1.

It should be observed that because of this particular disposition of the feed ducts 12 and 13 and of the internal channel 17, the fluid flows in equal and balanced manner along the ducts 12 and 13 because the two ducts 12 and 13 are connected to the internal channel 17 in symmetrical manner. Each of the ducts 12 and 13 is therefore always fed with the same quantity of fluid at any given flow rate.

Figure 4:
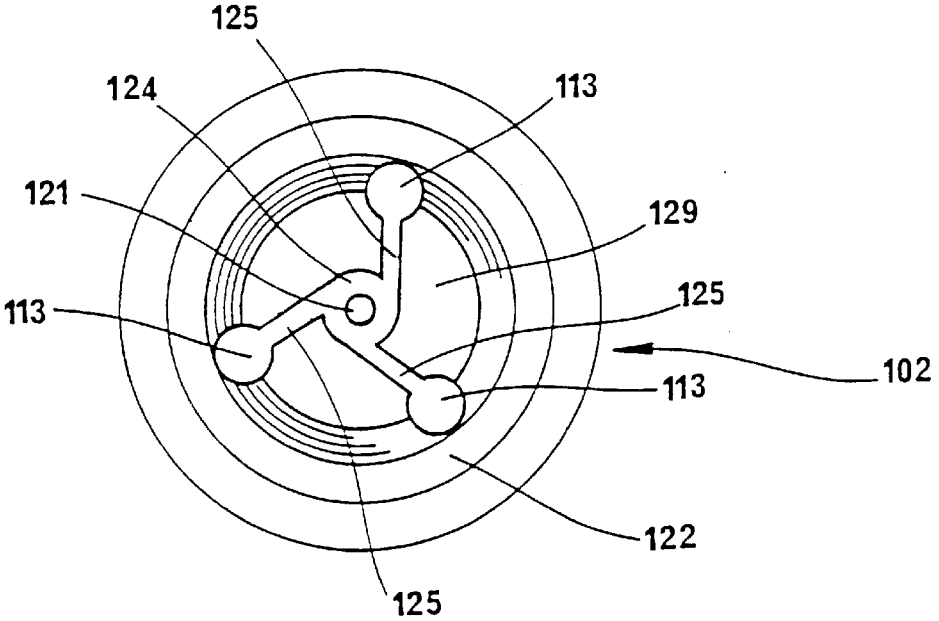

Also, compared with a conventional prior-art nozzle, in which the feed channels 113 (FIG. 4) are extremely fine, the two feed ducts 12 and 13 of the invention are of considerably greater section. Also, since the feed ducts connect with the internal channel 17 without constricted portions, there is no headloss at this position, whereas in the conventional prior-art nozzle the window 112 (FIG. 1) gives rise to a large amount of headloss immediately before the feed channels 113. Thus, because of the larger section of the feed ducts and because of the good junction between these ducts and the internal channel, the vortex channels can be fed with fluid in optimal manner without creating headloss before the inlets thereto.

The core 11 has a front end wall 19 which is set back a little inside the housing 10, by about 1 millimeter. This wall 19 is not plane, it incorporates a portion of the vortex chamber 14 and two vortex channels 15 and 16 which open out at one end each into the vortex chamber 14 in non-radial manner and at their respective opposite ends into the respective feed ducts, as can be seen in FIG. 5. Whereas it is the normal practice to mold the vortex channels and chamber in the atomizer, in the present invention they are molded in the front face of the core 11. The pin used in the mold for molding such a nozzle is of relatively simple design. The pin has two branches corresponding to the feed ducts 12 and 13 which are connected together by a bridge in which the negative of the vortex channels and chamber is machined, e.g. by electroerosion. The branches of the pin extend as far as the internal channel 17 which is itself formed by another pin that is cylindrical and whose top end is engaged between the two branches of the core pin. That is why the core is of substantially symmetrical trapezoidal shape, respectively to facilitate engaging the internal channel pin between the branches of the core pin and disengaging it therefrom. With reference to FIG. 7, it will be understood that the branches of the core pin engage in the internal channel 17. The portion of the spray nozzle that forms an integral portion of the pushbutton is thus very simple to make, while using only two pins that are both very simple.

Hydraulically-speaking, it must be observed that since that each of the vortex channels communicates with a feed duct, they are entirely symmetrical relative to the vortex chamber and will be fed with fluid in identical manner. This characteristic is particularly advantageous since it ensures that a well-formed vortex is formed in the vortex chamber.

The description above relates to the structure of the portion of the spray nozzle that is an integral portion of the pushbutton 1, i.e. is integrally molded therewith. The portion of the nozzle as described above needs to be associated with an atomizer which is given overall numerical reference 2 in FIGS. 6 to 10. Reference is made more particularly to FIGS. 7 to 10 while explaining its structure and its function, since it is shown on a larger scale therein.

In a manner corresponding to the shape of the housing 10 in which the atomizer 2 is received, the atomizer 2 is oblong in shape, being wider than it is tall. By way of example, the width of the atomizer is about 3 millimeters while its height is about 1 millimeter. These dimensions are not limiting. Compared with a conventional atomizer of the prior art, this represents a height saving of about 2 millimeters which applies directly to the height of the pushbutton 1. The atomizer is in the form of an oblong pellet pierced by a central orifice 21, referred to as a "spray" orifice. The spray orifice is formed between two symmetrical recesses that are substantially cylindrical and that are put into communication thereby, each defining a vortex chamber portion 24 that is additional to the chamber portion 14 formed in the core 11. According to an advantageous characteristic of the invention, the atomizer is symmetrical about a vertical plane perpendicular to the axis passing through the center of the spray orifice, and containing the longitudinal axis of the atomizer. This plane therefore passes between two vortex chamber portions 24, thus making the atomizer reversible, which explains why the additional portion 24 of the vortex chamber is provided twice over. Only one of these two additional chamber portions 24 will perform the function for which it is designed, while the other serves merely as an outlet bell. This reversibility of the atomizer makes it possible to eliminate a prior operation of orienting the atomizer before it is mounted on the pushbutton. This makes it possible to eliminate a baffle in the bowl that is used for orienting the atomizer in an assembly line.

To fasten the atomizer in the housing 10, the technique used is preferably to engage it as a force fit that involves interference. For this purpose, the atomizer is provided on its outer oblong periphery with a sealing rim 22 which makes the atomizer larger than the housing 10. By making the atomizer out of a material that is harder than that of the pushbutton, e.g. polyoxymethylene (POM) for the atomizer and polyethylene for the pushbutton, the rim 22 bites into the inside wall of the housing with the material thereof being deformed. To make it easier to engage the atomizer in the housing 10, the atomizer is formed with penetration chamfers that enable the atomizer to be centered automatically in its housing.

Once fully engaged in the housing 10, the atomizer comes into contact, via one of its faces 29 incorporating a vortex chamber portion 24, with the front wall 19 of the core incorporating the chamber 14 and the channels 15 and 16. Contact between the face 29 and the front wall 19 is leakproof, such that the vortex channels are isolated from each other between the complete vortex chamber 14, 24 and the respective feed ducts 12, 13.

In FIG. 6, the front wall 19 of the core extends vertically when the nozzle is held upright. In a variant, it is possible to make a core having a front face that is at an angle relative to the vertical. Under such circumstances, the atomizer is engaged obliquely, such that the jet is sprayed at a delivery angle relative to the horizontal. Such an embodiment may have a pharmaceutical application, for example, where it is necessary for the fluid container to remain in a vertical orientation while the jet is to be sprayed upwards at a predetermined delivery angle.

Figure 3:
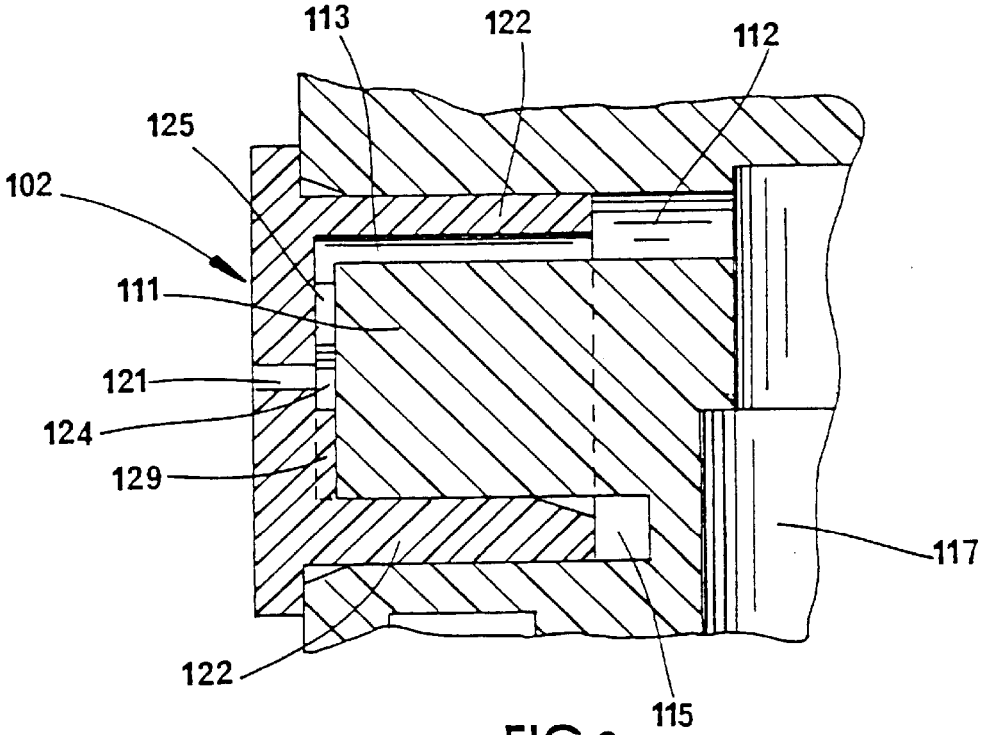

Conventionally, the vortex chamber is formed solely in the atomizer, but in this case it is constituted by two portions, one formed in the core and the other in the atomizer. This subdivision into two portions does not give rise to any complication concerning vortex formation in the vortex chamber, since it has been observed that the eye of the vortex always forms at the center of the spray orifice, providing the atomizer chamber portion is properly centered. In other words, the eye of the vortex forms in the spray orifice even if the two portions of the chamber are not exactly in alignment. Precision molding therefore needs to be applied to the atomizer. However, it is much easier to mold a flat atomizer (no annular skirt 122; FIG. 3) that is entirely symmetrical. The required mold comprises only two identical parts each including a pin for forming the vortex chamber portions 24 and the spray orifice. The two pins required are very short and it is known that molding precision is better when pins are short. Consequently, increased molding precision is obtained without requiring the use of higher precision pins. In the prior art, since the chamber was formed in the end wall of the atomizer, it was necessary to use a longer pin, thereby losing precision. Because of the invention, the atomizer is easily molded using a minimum amount of material, and using a very simple two-part mold. It is also easy to mount it on the pushbutton because it is reversible and because of the smaller pressure that acts thereon. Since the atomizer has a bearing surface area that is less than half that of a conventional atomizer, the force exerted thereon is also less than half, since force is proportional to bearing surface area. It is therefore possible to use fastener means of lower performance for inserting the atomizer in the housing 10, and the means described merely constitute a preferred embodiment.

I claim:

1. A spray nozzle for mounting on an outlet channel (3) of a dispenser device for dispensing a fluid to divide said fluid into fine droplets, said spray nozzle comprising a core (11) and an atomizer (2) hermetically received in a housing of said nozzle, said core and said atomizer together defining:

a vortex chamber (14, 24) which communicates with the outside via a spray orifice (21) formed in said atomizer (2); and a plurality of vortex channels (15, 16) opening out into said vortex chamber (14, 24) in a non-radial manner;

said spray nozzle being characterized in that said atomizer (2) is oblong in shape and a portion of said housing receiving said atomizer is oblong in shape, both having their longitudinal major axes extending in a horizontal plane when said spray nozzle is mounted on said outlet channel of said dispenser device.

2. A spray nozzle according to claim 1, in which said vortex channels (15, 16) communicate with the outlet channel (3) of the spray device via a plurality of symmetrical feed ducts (12, 13), with each of the vortex channels (15, 16) corresponding to a respective feed duct (12, 13) so that all of the vortex channels (15, 16) are fed with fluid in equal manner.

3. A spray nozzle according to claim 2, in which the number of feed ducts (12, 13) is two, said ducts extending on either side of the core (11) in a horizontal plane.

4. A spray nozzle according to claim 1, characterized in that said vortex channels (15, 16) and at least a portion (14) of the vortex chamber are formed in a front wall (19) of the core (11), the atomizer (2) having an inside wall (29) in sealing contact with said front wall (19) of the core (11) to isolate the vortex channels (15, 16) from one another.

5. A spray nozzle according claim 1, in which the atomizer (2) forms a portion (24) of the vortex chamber.

6. A spray nozzle according to claim 1, in which the atomizer (2) is symmetrical about a plane extending perpendicularly to the axis passing through the spray orifice (21), such that the atomizer has two identical faces (29) and is thus reversible.

7. A spray nozzle according to claim 1, in which said atomizer (2) is hermetically received in said housing (10) containing feed ducts (12, 13) and said core (11), said atomizer (2) being provided on its periphery in contact with said portion of said housing (10) receiving said atomizer (2) with a sealing rim (22) that bites into a material constituting said housing (10).

8. A spray nozzle according to claim 7, in which said atomizer (2) has a peripheral penetration chamfer (28) to facilitate mounting said atomizer (2) in said portion of said housing (10) receiving said atomizer (2).

9. A spray nozzle according to claim 1, in which the outlet channel (3) of the spray device has a crenelated free end (30) which communicates with feed ducts (12, 13) of the nozzle.

10. A spray nozzle according to claim 1, in which the nozzle forms an integral portion of a pushbutton (1) mounted on a hollow actuator rod defining the outlet channel (3).

11. A spray nozzle according to claim 2, in which the core (11) forms a separation wall between the feed ducts (12, 13).

12. A spray nozzle comprising a core and an oblong atomizer engaged within a housing, said housing defining an oblong cavity within a pushbutton, said core and said atomizer together defining:

a vortex chamber which communicates with the outside via a spray orifice formed in said atomizer; and a plurality of vortex channels opening out into the vortex chamber in non-radial manner;

wherein longitudinal major axes of said oblong atomizer and said housing defining an oblong cavity extend in a horizontal plane with respect to said pushbutton.

* * * * *